US009427858B2

(12) United States Patent
Duncan et al.

(10) Patent No.: US 9,427,858 B2
(45) Date of Patent: Aug. 30, 2016

(54) MULTIPURPOSE TOOL

(75) Inventors: Michael L. Duncan, Portland, OR (US); Blair Scott Barnes, Portland, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 387 days.

(21) Appl. No.: 13/597,067

(22) Filed: Aug. 28, 2012

(65) Prior Publication Data

US 2014/0059782 A1 Mar. 6, 2014

(51) Int. Cl.
*B25F 1/00* (2006.01)
*B25F 1/04* (2006.01)

(52) U.S. Cl.
CPC .. *B25F 1/00* (2013.01); *B25F 1/04* (2013.01)

(58) Field of Classification Search
CPC ..... B25F 1/00; B25F 1/04
USPC ..... 7/118, 138; 81/427.5
See application file for complete search history.

(56) References Cited

U.S. PATENT DOCUMENTS 5,878,834 A * 3/1999 Brainerd et al. ..... 182/3
6,145,994 A * 11/2000 Ng ..... B25F 1/02 206/234
6,223,372 B1 * 5/2001 Barber ..... 7/118
6,571,940 B2 * 6/2003 Newman ..... A45C 11/00 206/234
6,594,906 B1 * 7/2003 Sakai et al. ..... 30/155
7,000,323 B1 * 2/2006 Hatcher ..... B26B 1/046 30/155
7,126,484 B1 * 10/2006 Luquire ..... 340/574
7,475,456 B2 * 1/2009 Thompson ..... F16B 45/02 24/599.9
D588,885 S * 3/2009 Barber et al. ..... D8/22
7,698,970 B1 * 4/2010 Chavez ..... B25B 13/04 7/138
7,712,399 B2 * 5/2010 Nenadic ..... 81/427.5
7,913,591 B2 * 3/2011 Nenadic ..... 81/427.5
8,087,115 B2 * 1/2012 Barber et al. ..... 7/167
8,166,850 B2 * 5/2012 Caniparoli et al. ..... 81/427.5
2002/0064040 A1 * 5/2002 Padden ..... B25C 5/0214 362/119
2005/0144730 A1 * 7/2005 Barber et al. ..... 7/138
2009/0000965 A1 * 1/2009 Arbel ..... A45C 11/18 206/38
2012/0317762 A1 * 12/2012 Tardif ..... 24/601.5

* cited by examiner

*Primary Examiner* — Hadi Shakeri
*Assistant Examiner* — Danny Hong
(74) *Attorney, Agent, or Firm* — Alston & Bird LLP

(57) ABSTRACT

Provided herein is a multipurpose tool configured to provide multiple tools and functions for a user according to a specific activity or sport. Embodiments may provide a tool including a frame configured to define a plurality of tools disposed about a perimeter, where the frame defines at least one recess disposed about the perimeter, where at least one recess is configured to hold an earbud headphone. The frame of the tool may define a cavity at least partially surrounded by the perimeter, where the cavity may be configured to removably engage a separable and independently operable device. The cavity may be configured to removably receive a multipurpose tool. The tool may further include a gate biased into engagement with the frame, where the cavity is fully encircled by the frame and the gate, and access to the cavity through the frame is provided by opening the gate.

13 Claims, 8 Drawing Sheets

MULTIPURPOSE TOOL

FIELD

Embodiments of the present invention relate generally to tools and, more particularly, to a tool, such as a multipurpose tool, configured to engage a device, such as another multipurpose tool or a music player, and to provide a plurality of easily accessible tools and features to a user.

BACKGROUND

Multipurpose tools are widely popular for their utility in a substantial number of different applications. As its name suggests, a multipurpose tool includes a number of tools carried by a common frame. A multipurpose tool may include different combinations of tools depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tools that are useful for the intended application. For example, multipurpose tools may be specifically designed for automobile repairs, hunting, fishing, biking, snowboarding, or other outdoor applications, gardening and the like.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool.

As multipurpose tools are frequently carried by users in the field, it is desirable for the multipurpose tools to be relatively small and lightweight while remaining rugged so as to resist damage. Additionally, it may be desirable for the tool to be configured so as to provide a plurality of tools that are easily accessible to a user while not being cumbersome or overly complex.

BRIEF SUMMARY OF THE INVENTION

Embodiments of the present invention may include a multipurpose tool configured to provide multiple tools and functions for a user according to a specific activity or sport. Embodiments of the invention may provide a tool including a frame configured to define a plurality of tools disposed about a perimeter, where the frame defines at least one recess disposed about the perimeter with one at least one recess being configured to hold an earbud headphone. The frame of the tool may define a cavity at least partially surrounded by the perimeter, where the cavity may be configured to removably engage a separable and independently operable device.

The cavity may be configured to removably receive a multipurpose tool. The tool of example embodiments may further include a gate biased into engagement with the frame, where the cavity is fully encircled by the frame and the gate, and access to the cavity through the frame is provided by moving the gate against the bias. The multipurpose tool received within the cavity defined by the frame may include a carabineer including a gate. When the multipurpose tool is received by the frame, the gate of the carabineer of the multipurpose tool may be configured to be depressed against a bias in response to the gate of the frame being depressed against the bias.

Additionally or alternatively, the cavity may be configured to removably receive a music player. The frame of example embodiments may further define a lace tightening tool, the lace tightening tool defining a slot configured to receive a lace therein, where the slot is defined by at least one textured surface configured to engage a lace. The tool may include a wrench which may be configured to engage a hexagonal nut or bolt. The frame may include a thickness of between about 2.0 millimeters and 5.0 millimeters. Each of the plurality of tools disposed about the perimeter of the tool may be integrally formed into the frame, and the tools may each include a thickness not to exceed the thickness of the frame. The plurality of tools may include a bottle cap opener, a screw driver, and scraper.

Another example embodiment of a tool according to the present invention may include a frame defining a cavity, where the cavity may be configured to receive a multipurpose tool. The tool may also include a gate disposed on the frame movable between an open position and a closed position, where in the open position the gate may be configured to provide access to the cavity. The tool may further include a multipurpose tool received within the cavity, where the multipurpose tool may include a carabineer with a gate movable between an open position and a closed position. When the multipurpose tool is disposed within the cavity, the gate of the carabineer of the multipurpose tool may be configured to be moved from the closed position to the open position in response to the gate of the frame moving from the closed position to the open position. The gate of the frame and the gate of the carabineer may each be biased in the closed position.

Embodiments of the present invention may provide a tool including a frame configured to define a plurality of tools disposed about the perimeter, where each of the plurality of tools disposed about the perimeter are integrally formed into the frame, and where the tools each comprise a thickness not to exceed the thickness of the frame. The frame may define a cavity at least partially surrounded by the perimeter, where the cavity may be configured to removably engage a separable and independently operable device. The frame may further include a gate configured to be moved between an open position and a closed position, where the gate may be configured to provide access through the frame to the cavity in response to being moved to the open position. The independently operable device may include a multipurpose tool, where the multipurpose tool may include a carabineer including a gate movable between an open position and a closed position, where the gate of the carabineer may be configured to be moved to the open position in response to the gate of the frame being moved to the open position when the multipurpose tool is disposed within the cavity of the frame. The frame may define a first end, a second end, and a middle portion disposed there between, where the first end includes a first width and the second end includes a second width with the middle portion defining a third width that is less than the first width and the second width.

Tools according to some embodiments of the present invention may include two recesses defined within the frame, disposed about the perimeter, where each recess is configured to hold a respective one of a pair of earbuds. The two recesses for the earbuds may be proximate the first end. The pair of earbuds may be disposed at one end of a cable and an audio connector may be disposed at the other end of the cable. The frame may define a third recess disposed on the perimeter, where the third recess is configured to receive the audio connector and is disposed proximate the second end. The frame may include a thickness of between about 2.0 millimeters and 5.0 millimeters, where the plurality of tools each include a thickness of less than or equal to the thickness of the frame.

BRIEF DESCRIPTION OF THE SEVERAL VIEWS OF THE DRAWINGS

Figure 1:
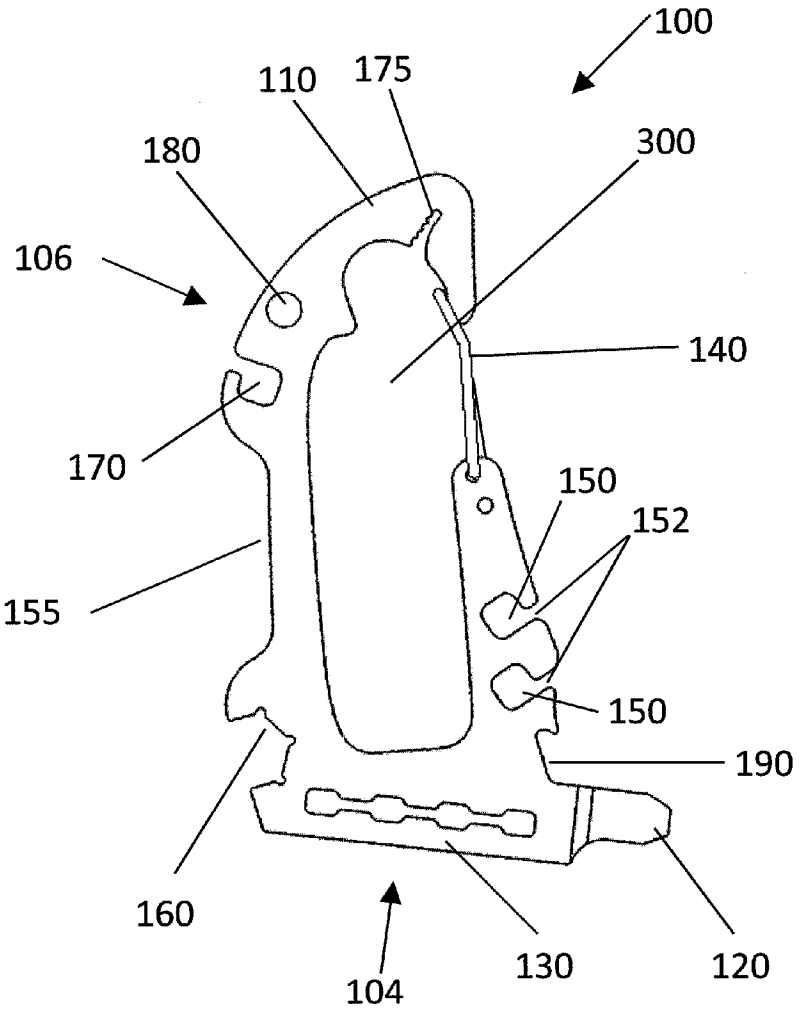
Figure 2:
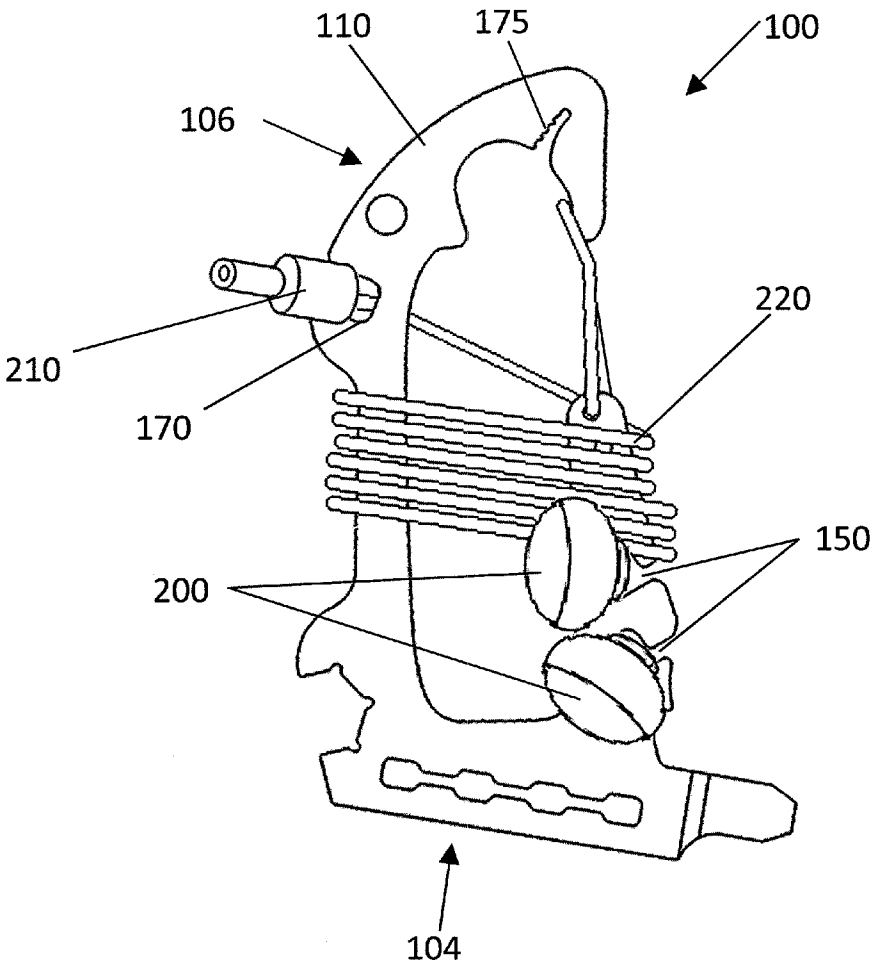
Figure 3:
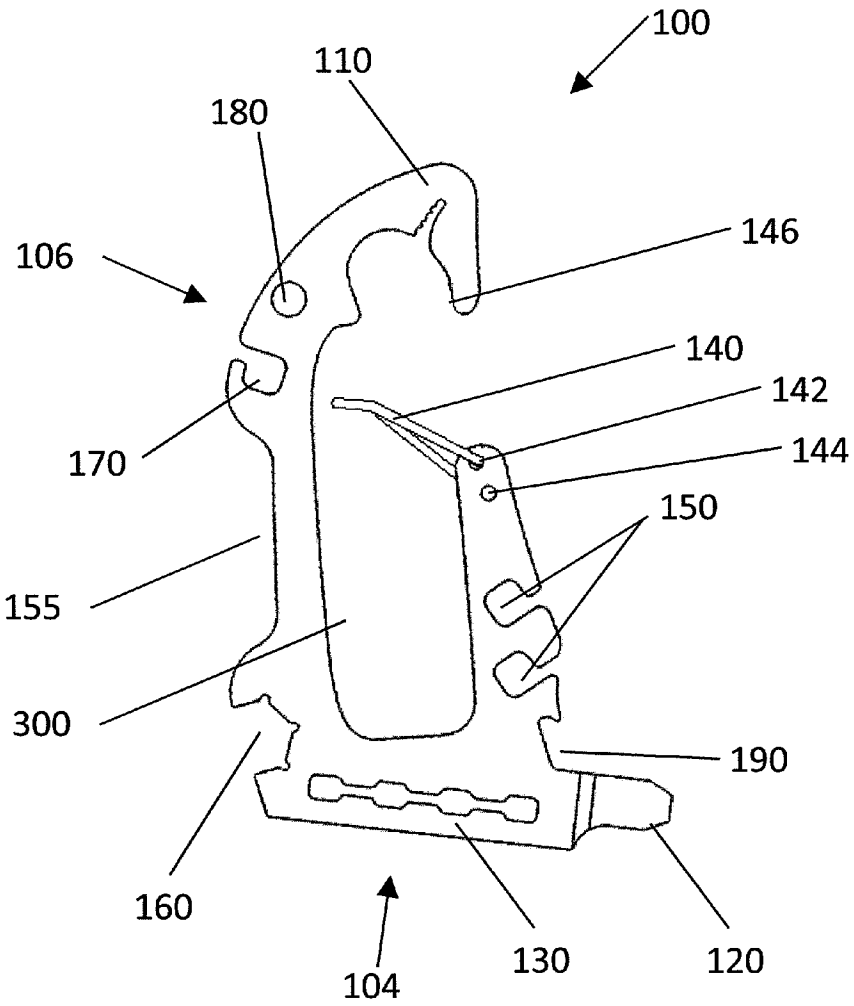
Figure 4:
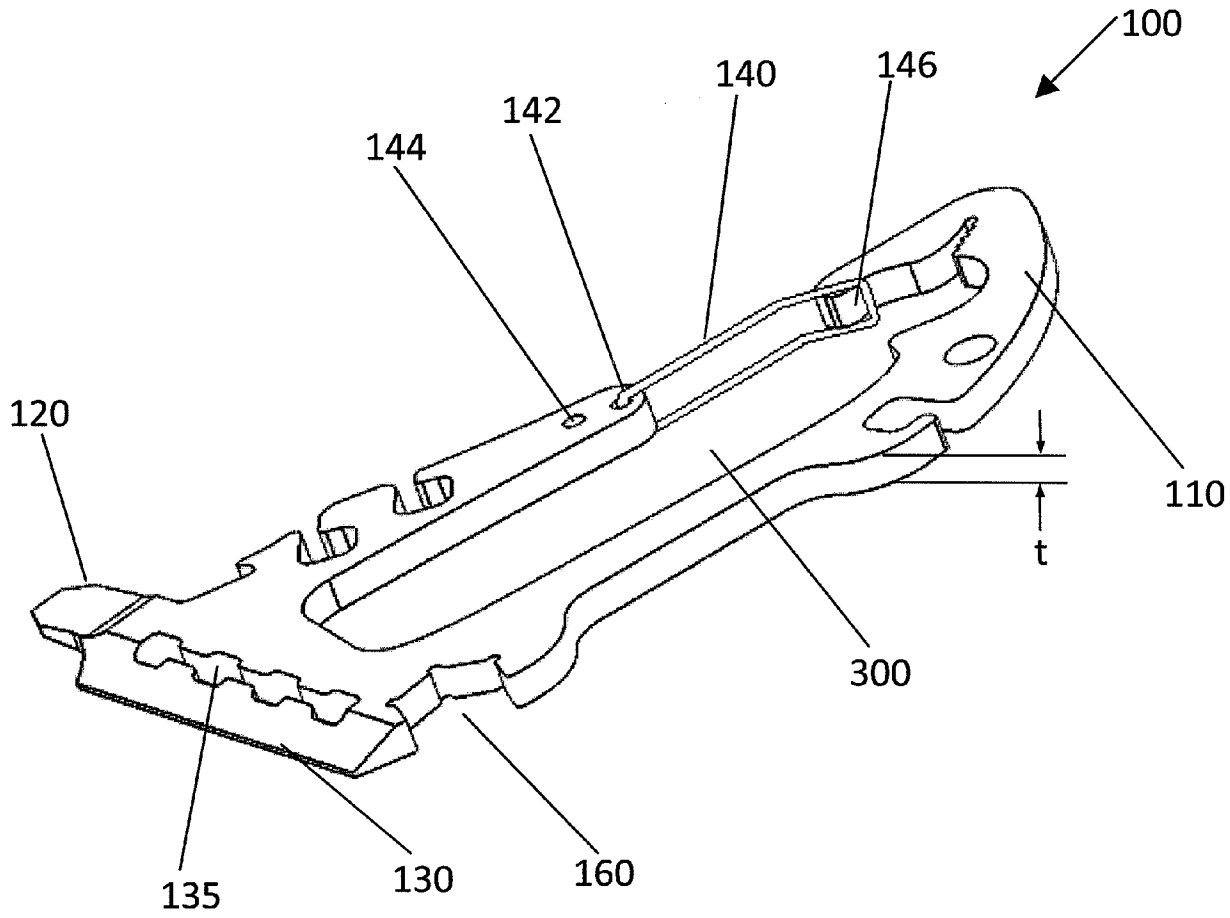
Figure 5:
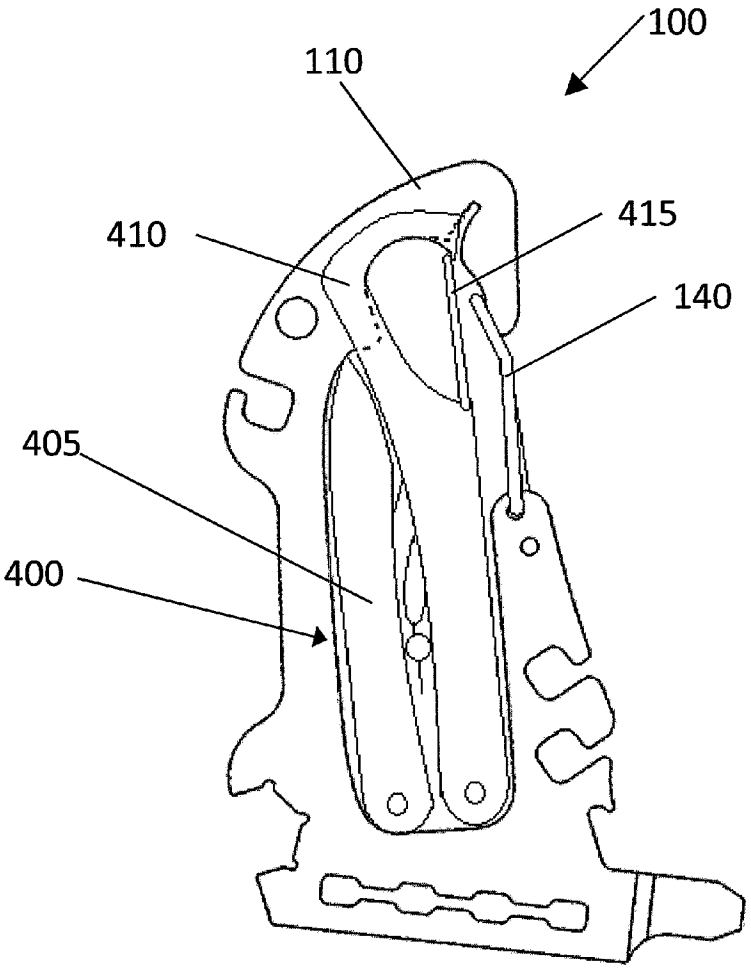
Figure 6:
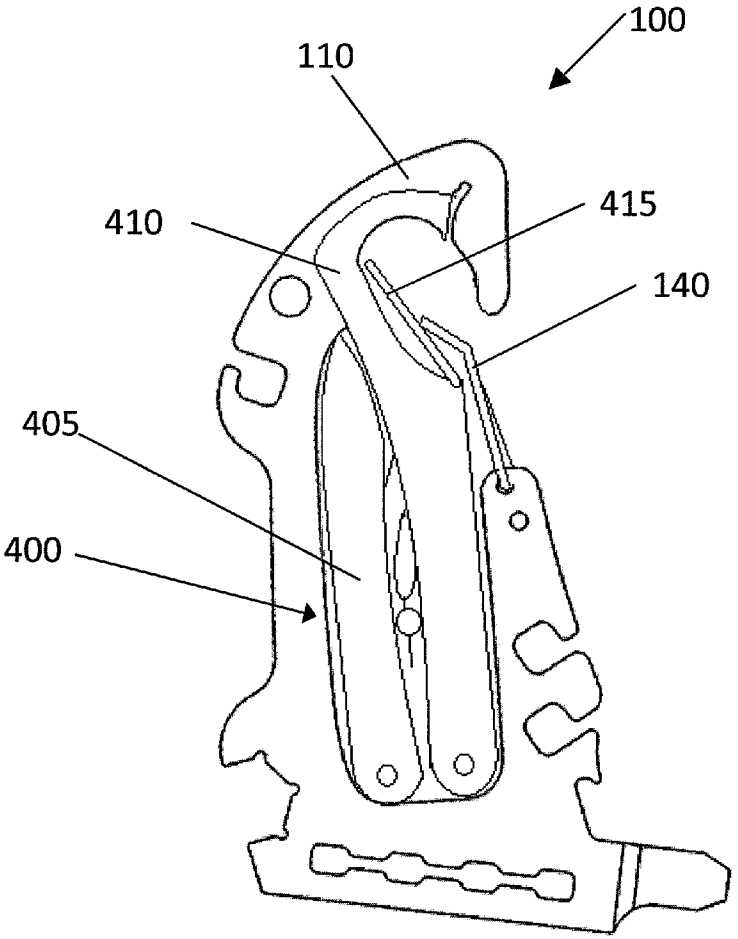
Figure 7:
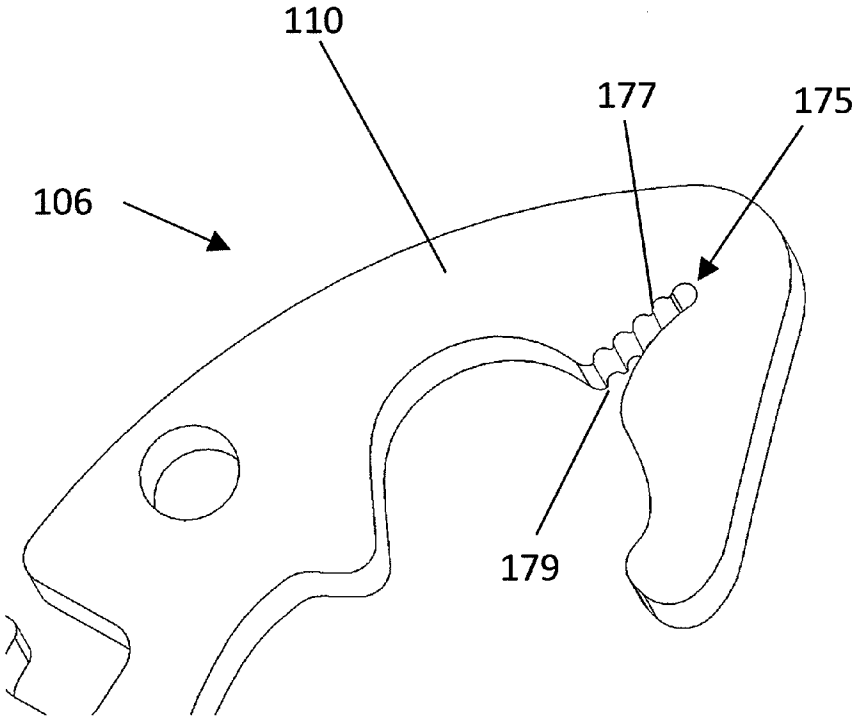
Figure 8:
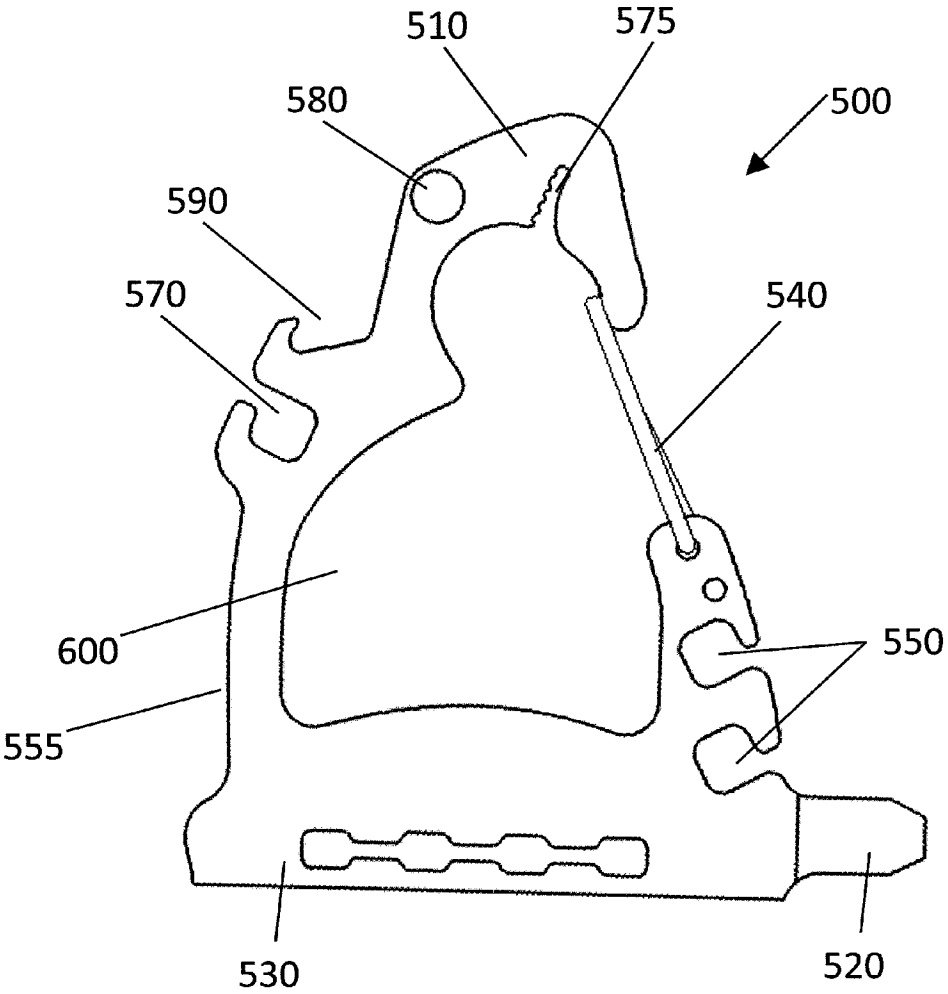

Having thus described the invention in general terms, reference will now be made to the accompanying drawings, which are not necessarily drawn to scale, and wherein:

FIG. 1 illustrates an example embodiment of a multipurpose tool according to the present invention;

FIG. 2 illustrates the multipurpose tool of FIG. 1 engaging a pair of earbud headphones, the cable, and associated connector;

FIG. 3 illustrates the multipurpose tool of FIG. 1 with the gate in the open position;

FIG. 4 illustrates a perspective view of the multipurpose tool of FIG. 1;

FIG. 5 illustrates a second multipurpose tool received within the cavity of the multipurpose tool of the embodiment of FIG. 1;

FIG. 6 illustrates the multipurpose tool of the embodiment of FIG. 1 and the second multipurpose tool received therein, each with their gates disposed in the open position;

FIG. 7 illustrates an enlarged view of the second end of the multipurpose tool of the embodiment of FIG. 1; and FIG. 8 illustrates a multipurpose tool according another embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIGS. 1-6, a tool, such as a multipurpose tool 100, according to one embodiment of the invention is depicted. While the tool will be described in the context of a multipurpose tool, other types of tools may readily employ embodiments of the present invention including knives and other tools that are not considered multipurpose tools. For purposes of illustration, but not of limitation, a multipurpose tool employing an embodiment of the present invention will now be described.

The multipurpose tool 100 of the illustrated embodiment includes a rigid frame 110 configured to define a plurality of tools disposed about a perimeter of the frame 110. The frame 110 may also define a pair of recesses 150, where each one of the pair of recesses is configured to hold a respective one of a pair of earbud-style headphones. Each recess 150 may be configured with an opening 152 that is narrower than the recess such that the opening may accept the cord of each earbud there through, while the earbud itself may be captured by the recess 150 and cannot pass through the recess 150 or the opening 152.

The rigid frame 110 may define a first end 104 and a second end 106, where the first end and the second end are wider (as viewed from the perspective of FIG. 1) than a center section 155. The center section 155 may be configured such that the cord from a pair of earbud headphones may be wound about the center section 155 without sliding off of the first end 104 or the second end 106. A third recess 170 may be defined by the frame and, in one embodiment, is disposed proximate the second end 106 of the frame 110. The third recess may be configured to receive a connector, such as a ⅛-inch audio plug, which is disposed on the earbud headphone cable opposite the earbuds. In this manner, the earbud headphones may be securely wrapped around the frame 110 such that they are unlikely to unwind or slide off of the tool 100.

FIG. 2 illustrates the multipurpose tool 100 of FIG. 1 with a pair of earbud headphones 200 received within the recesses 150 and a connector 210 received within the third recess 170. As shown, the cord is received about the center section 155 as it is wound about the frame 110. The cord 220 of the earbud headphones is unlikely to unwind as each of the ends (the earbuds 200 and the connector 210) are captured within recesses 150 and 170, and the cord is precluded from sliding off of the frame by the frame ends 104, 106 being wider than the center section 155.

The frame 110 of the illustrated embodiment is formed of a rigid material, such as steel or aluminum, and may include a thickness (t) of between about 2.0 millimeters and 5.0 millimeters, as shown in the perspective view of FIG. 4. Further example embodiments may include a frame of a less rigid material, such as plastic; however, in such an example embodiment, the tools disposed about the perimeter of the frame may be made of a different material that is integrally formed with the frame. For example, the tools, such as screw driver 120, may be made of steel while the frame may be a high-density polyethylene molded over the screw driver tool, with the screw driver tip exposed for use. In such an embodiment where the frame is of a material less rigid than a steel or aluminum construction, the frame may be substantially thicker than that of a more rigid material.

The frame 110 of the illustrated embodiment of FIG. 1 may substantially surround and define a cavity 300. The frame 110 may include a gate 140 that is configured to be moveable between an open position and a closed position similar to the operation of a carabineer. FIG. 3 illustrates the embodiment of FIG. 1 with the gate 140 in the open position, providing access to the cavity 300 through the frame 110. The gate 140 may be biased toward the closed position. For example, as illustrated in FIG. 4, the gate 140 may include a loop of resilient material with two ends. The two ends may be configured to engage two separate openings within the tool, 142 and 144. By virtue of the alignment of the loop of resilient material, in response to the gate 140 being moved to the open position, the resiliency of the material biases the gate 140 back toward the closed position, into engagement with a stop 146 of the frame 110. This bias maintains the gate 140 in the closed position, thereby encircling the cavity 300.

The continuous frame 110 and the gate 140 biased in the closed position may allow a user to clip the tool 100 to a location, such as a belt-loop or an easily accessible position on a user's clothing or other secure position.

The cavity 300 of example embodiments may be configured to removably receive a separable and independently operable device. In the illustrated embodiment of FIGS. 1-4, the cavity may be configured to receive another multipurpose tool, such as the second multipurpose tool shown in FIG. 5. Although the cavity defined by the frame may be sized and shaped to receive various types of multipurpose tools, the second multipurpose tool 400 of FIG. 5 may include a tool body 405 and a carabineer 410 including gate 415. In the illustrated embodiment, the carabineer 410 portion may include a recess adapted to receive a portion of the frame 110, which can be seen in the illustrated dashed lines. The shape of the cavity 300 may be configured to securely receive the tool body 405, such that when the recess of the carabineer 410 engages a portion of the frame 110, and the tool body 405 is received within the cavity 300, the second multipurpose tool 400 is securely held in place within the frame 110, such as by a combination of frictional engagement and the engagement of a portion of the frame 110 by the second multipurpose tool 400. A user may remove the second multipurpose tool 400 from the cavity 300 by pressing the tool body 405 from the cavity 300, and sliding the carabineer 410 away from the portion of the frame 110 which is engaged.

When the second multipurpose tool 400 of the illustrated embodiment of FIG. 5 is engaged with the tool 100, the gate 140 of multipurpose tool 100 may function in cooperation with the gate 415 of the carabineer 410 of the second multipurpose tool 400. FIG. 6 illustrates the gate 140 of the tool in the open position, whereby in response to the gate 140 being moved to the open position, the gate 140 engages the gate 415 of the second multipurpose tool 400 and moves the gate 415 to the open position, providing access to the carabineer 410 of the second multipurpose tool 400.

Referring back to FIG. 1, a multipurpose tool of an embodiment of the present invention may include tools or features that are configured to address a particular need or are suited for a particular sport or activity. The illustrated embodiment of FIG. 1 may be useful for a variety of sports or activities, such as snowboarding or the like. The multipurpose tool 100 of FIG. 1 may include a tapered edge 130 proximate one end of the tool 100 which may be used for scraping, such as scraping wax from a snowboard, scraping ice from a windshield, etc. The tapered edge 130 is further illustrated in FIG. 4 which depicts a perspective view of the multipurpose tool 100. An opening 135, cavity, or other feature may be disposed proximate the tapered edge 130 to improve the efficiency of the scraping of some materials. For example, wax, when scraped, may adhere to the surface of the tool and of the tapered edge 130. Introducing an opening 135 or other surface disruption may cause the wax to better separate from the tapered edge 130 as the wax builds up proximate the edge 130.

The multipurpose tool 100 of example embodiments may further include one or more wrenches, such as wrench 160 of FIG. 1, configured to engage a hexagonal-shaped bolt or nut. The wrenches of example embodiments may be sized according to common sized fasteners encountered in the sport or activity for which the multipurpose tool is intended. For example, a 10-millimeter wrench may be included in a multipurpose tool intended for snowboarders as the 10-millimeter size bolt and/or nut is a fastener commonly encountered in such an endeavor. Other example embodiments may include a ½-inch wrench on a multipurpose tool designed for automotive use as the ½-inch size is commonly encountered on vehicles and motorcycles. The wrench 160 may be located toward an end of the tool in order to provide a user the maximum moment-arm for applying the greatest force to a fastener through the wrench 160. In example embodiments in which multiple wrenches may be included, the larger size wrenches may be closer to an end of the tool in order to provide a longer moment arm for larger fasteners as larger fasteners typically require greater forces or torques to be applied.

Example embodiments of the present invention may further include a screwdriver 120, such as the flat-head screwdriver 120 illustrated in FIGS. 1-6. The flat-head screwdriver is a versatile tool that can find uses beyond tightening and loosening slotted-screws. For example, the flat-head screwdriver may be used to chisel or chip away at a material, pry two elements apart, or various other uses. As such, it may be desirable to position the screwdriver 120 opposite a surface which may be struck with force while the multipurpose tool 100 is held by a user. Additionally, as the screwdriver 120 may be needed to apply a large force or torque to a fastener, the screwdriver 120 may be positioned proximate an end of the tool 100, with the tool body arranged perpendicular to the axis of rotation of a fastener that would be engaged by the screwdriver 120. While a flat-head screwdriver is depicted in the illustrated embodiments, additional drivers may be included in addition to, or in place of the flat-head screwdriver 120. For example, a Philips-head screwdriver, a Torx® driver, a Torx Plus® driver, an allen-key, etc.

According to some example embodiments of a multipurpose tool of the present invention, a bottle cap opener 190 may be included. Further, an attachment hole 180 may be present to allow the multipurpose tool 100 to be attached to a keychain, key ring, lanyard, or the like.

FIG. 7 illustrates an enlarged view of the second end 106 of the multipurpose tool of FIGS. 1-6. The illustrated embodiment further includes a lace-tightener 175. The lace-tightener 175 may include a slot 179 for receiving a lace there through and a relatively rough-textured or serrated edge 177 of the slot 179 configured to engage and grip a lace. The lace-tightener may be useful in a tool well-suited for use for an outdoor activity where a user's hands may be wet, cold, or otherwise insufficient for comfortably and securely grasping a lace in order to tighten the laces of a shoe, boot, binding, etc. The lace may be inserted into the slot 179 and a user may angle the tool such that the lace is engaged by the rough-textured or serrated edge 177, whereby the user may then securely pull on the lace to apply the force that is necessary.

As multipurpose tools according to embodiments of the present invention are intended to provide a convenient mechanism to perform numerous tasks, the tools may be configured to be conveniently worn or carried by a user. As noted above, the gate 140 may provide a user with the ability to clip the tool of the embodiment of FIGS. 1-6 to a belt-loop, backpack, or other article. However, a user may wish to carry the tool in a pocket, such as a shirt or pants pocket. Therefore, it may be desirable to ensure that there are no protrusions or objects that would either tear a pocket or provide discomfort to a user carrying the tool in their pocket. To that end, example embodiments of multipurpose tools of the present invention may be configured to be of a relatively flat form, with few or no protrusions from the flat profile.

As can be seen in the illustration of FIG. 4, the frame 110 of the tool is thin relative to the overall size of the tool. In the illustrated embodiment, the tool is approximately 2.0 to 5.0 millimeters and, more particularly, about 3.0 to 4.0 millimeters in thickness, shown as "t" in FIG. 4. None of the tools disposed about the perimeter of the multipurpose tool 100 of the illustrated embodiment extend beyond the thickness "t" of the tool 100 such that the tool may be comfortably carried in a pocket. The gate 140 may extend beyond the thickness "t"; however, as the gate does not include sharp corners, the gate will generally not be a discomfort when carried by a user.

FIG. 8 illustrates another example embodiment of a multipurpose tool 500 according to the present invention. The tool of FIG. 8 includes many of the features of the tool of FIGS. 1-6; however the tool 500 may be configured to receive in the cavity 600 a music player or other separable and independently operable device. The multipurpose tool 500 includes a gate 540 that is biased in the illustrated closed position, a flat-head screwdriver 520, a beveled surface 530 for use as a scraping tool, a key ring hole 580, and a bottle cap opener 590. The tool may further include recesses 550 for a pair of earbud headphones and a recess 570 for receiving a connector. The tool 500 may further include middle section 555 arranged for winding the cable of a pair of earbud headphones around. As illustrated, the multipurpose tool of example embodiments may be sized and shaped according to various needs and may be configured with a cavity 600 appropriately sized for receiving any number of separable, independently operable devices. In the illustrated embodiment, a music player with a clip disposed thereon may be configured to clip to the section of the tool between the beveled edge 530 and the cavity 600. However, the tool of this embodiment may be configured to engage the music player in other manners such as by frictional engagement and/or by other mechanical engagement between the tool and the music player.

As described above and illustrated in the figures, embodiments of the present invention may be configured and sized according to the particular needs of an application. The cavities of example embodiments may be sized to accommodate various ancillary devices which may be independently useful from the multipurpose tool, but which may be conveniently carried within the multipurpose tool. Further, a variety of combinations of tools disposed about the perimeter of example embodiments may be implemented for various activities or sports for which the multipurpose tool may be designed, such as bicycling, skateboarding, or the like.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tool combination comprising:

a frame configured to define a plurality of tools disposed about a perimeter;

a multipurpose tool removably received within a cavity defined by the frame, wherein the multipurpose tool is substantially surrounded by the frame in response to being received within the cavity; and a gate biased into engagement with the frame, wherein the cavity is fully encircled by the frame and the gate, and wherein access to the cavity through the frame is provided by moving the gate against the bias;

wherein the frame defines at least one recess disposed about the perimeter, at least one recess configured to hold a respective earbud, and wherein the cavity is at least partially surrounded by the perimeter.

2. The tool according to claim 1, wherein the multipurpose tool comprises a carabineer including a gate, and wherein, when the multipurpose tool is received by the frame, the gate of the carabineer of the multipurpose tool is configured to be depressed against a bias by the gate of the frame in response to the gate of the frame being depressed against the bias.

3. The tool of claim 1, wherein the frame defines a lace tightening tool, the lace tightening tool defining a slot configured to receive a lace therein, wherein the slot is defined by at least one textured surface configured to engage a lace.

4. The tool of claim 1, further comprising a wrench.

5. The tool of claim 4, wherein the wrench is configured to engage a hexagonal nut or bolt.

6. The tool of claim 1, wherein each of the plurality of tools disposed about the perimeter are integrally formed into the frame, and wherein the tools each comprise a thickness not to exceed the thickness of the frame.

7. The tool of claim 6, wherein the plurality of tools comprises a bottle cap opener, a screw driver, and a scraper.

8. An apparatus comprising:

a frame defining a cavity, wherein the cavity is configured to receive a multipurpose tool;

a gate disposed on the frame movable between an open position and a closed position, wherein in the open position the gate is configured to provide access to the cavity; and a multipurpose tool received within the cavity, wherein the multipurpose tool comprises a carabineer including a gate moveable between an open position and a closed position;

wherein when the multipurpose tool is disposed within the cavity, the gate of the carabineer of the multipurpose tool is moved from the closed position to the open position in response to the gate of the frame moving from the closed position to the open position, and wherein the frame comprises a thickness of between about 2.0 millimeters and 5.0 millimeters, and wherein the plurality of tools each comprise a thickness less than or equal to the thickness of the frame.

9. The apparatus of claim 8, wherein the gate of the frame is biased in the closed position, and wherein the gate of the carabineer is biased in the closed position.

10. An apparatus comprising:

a frame configured to define a plurality of tools disposed about a perimeter; and a multipurpose tool received within a cavity defined by the frame, wherein each of the plurality of tools disposed about the perimeter are integrally formed into the frame, wherein the tools each comprise a thickness not to exceed the thickness of the frame, wherein at least a portion of the multipurpose tool engages the frame on opposing sides of the frame, wherein the cavity is at least partially surrounded by the perimeter, wherein the cavity is configured to removably engage the multipurpose tool which is a separable and independently operable device, wherein the frame further comprises a gate configured to be moved between an open position and a closed position, and wherein the gate is configured to provide access through the frame to the cavity in response to being moved to the open position.

11. The apparatus of claim 10, wherein the multipurpose tool comprises a carabineer including a gate movable between an open position and a closed position, wherein the gate of the carabineer is moved to the open position in response to the gate of the frame being moved to the open position when the multipurpose tool is disposed within the cavity of the frame.

12. The apparatus of claim 10, wherein the frame defines a first end, a second end, and a middle portion disposed there between, wherein the first end comprises a first width, the second end comprises a second width, and the middle portion defines a third width that is less than the first width and the second width.

13. The apparatus of claim 12, wherein the frame defines two recess disposed about the perimeter, each recess configured to hold a respective one of a pair of earbuds, wherein the two recesses configured to hold a pair of earbuds are arranged proximate the first end, wherein the pair of earbuds are disposed at one end of a cable and wherein an audio connector is disposed at the other end of the cable, and wherein the frame defines a third recess configured to receive the audio connector, wherein the third recess is arranged proximate the second end.

* * * * *